US006685294B2

(12) United States Patent
Gaasch et al.

(10) Patent No.: US 6,685,294 B2
(45) Date of Patent: Feb. 3, 2004

(54) METHOD FOR CONTROLLING MEDIA EJECTION

(75) Inventors: Todd M. Gaasch, Vancouver, WA (US); Michael A. Fairchild, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 37 days.

(21) Appl. No.: 09/845,451

(22) Filed: Apr. 30, 2001

(65) Prior Publication Data

US 2002/0158929 A1 Oct. 31, 2002

(51) Int. Cl.[7] ..... B41J 29/38
(52) U.S. Cl. ..... 347/16
(58) Field of Search ..... 271/258.01, 270; 700/33, 46, 213, 303; 400/625; 347/16

(56) References Cited

U.S. PATENT DOCUMENTS 5,071,113 A * 12/1991 Nakamura et al. ..... 271/270
5,149,080 A * 9/1992 Yamamoto ..... 271/193
5,249,795 A * 10/1993 Nishimoto ..... 271/265.02
5,407,191 A * 4/1995 Ukai ..... 271/202
5,648,807 A 7/1997 Saito et al.
5,730,537 A 3/1998 Kelly et al.
5,807,003 A * 9/1998 Kobayashi et al. ..... 271/314
5,856,833 A 1/1999 Elgee et al.
6,386,669 B1 * 5/2002 Scofield et al. ..... 347/105
6,386,671 B1 * 5/2002 Huston et al. ..... 347/16
6,406,119 B1 * 6/2002 Cho ..... 347/16
6,485,124 B1 * 11/2002 King et al. ..... 347/19

* cited by examiner

*Primary Examiner*—Eileen D. Lillis
*Assistant Examiner*—Michael Lowe

(57) ABSTRACT

A method for analyzing one or more criteria to select a media ejection sequence is provided. A media sheet quality such as stiffness may be determined and utilized to select an optimized ejection sequence. A print job characteristic, such as the location of marking material on the media, may also be determined and utilized to select an optimized ejection sequence.

14 Claims, 3 Drawing Sheets

METHOD FOR CONTROLLING MEDIA EJECTION

TECHNICAL FIELD

The present invention relates generally to media handling in an imaging device and, more particularly, to a method that analyzes one or more criteria to select a media ejection sequence.

BACKGROUND

In imaging devices such as inkjet and electrophotographic printers, the typical imaging process includes picking a sheet of media from an input tray, feeding the sheet through an imaging zone and then ejecting the sheet through an output port into an output tray. In the process of ejecting the media sheet, one problem sometimes encountered is the under-ejection or over-ejection of the printed sheet. Under ejecting a sheet can leave the sheet in the path of a reciprocating carriage or other mechanism, thereby smearing the printed image and damaging the sheet and/or the mechanism. Over ejecting a sheet can cause the sheet to sail over the output tray and onto a support surface or floor, potentially damaging the sheet and fouling print job collation.

Prior imaging devices have utilized different ejection sequences based on the type of media being printed and the print speed required. In general, photo, glossy and other media with lower sheet-to-sheet friction need a slower ejection speed for the media to clear the output port. U.S. Pat. No. 5,730,537 discloses utilizing a slower media ejection speed for printing glossy media sheets to allow the sheets to move more gently into the output tray. By contrast, plain paper and other media with greater sheet-to-sheet friction generally require a faster ejection speed for the media to clear the output port.

One example of a printer that utilizes different ejection speeds is found in the DeskJet® 970 inkjet printer, manufactured by Hewlett-Packard Co. of Palo Alto, Calif. This printer selects between a fast and a slow media ejection speed based on the print quality selected by the user (Best, Normal or Draft). The printer will select the slower ejection speed for the Best and Normal settings where printing speed or throughput is less critical to a user, and the faster speed for Draft print jobs where greater throughput is desired. However, the two ejection speeds are not optimized for the numerous media types that may be printed on the printer, and under-ejection and over-ejection may still occur.

Thus, a need exists for an improved method for reliably ejecting media that addresses the limitations of the prior art.

SUMMARY OF THE INVENTION

The present invention provides a method for analyzing one or more criteria to select an optimized media ejection sequence. One embodiment of the method of the present invention can be broadly summarized by the following steps: determining a stiffness of the media sheet; using the stiffness to identify from a plurality of ejection sequences an optimized ejection sequence; and ejecting the media utilizing the optimized ejection sequence.

In another embodiment, the method may be broadly summarized by the following steps: determining a print job characteristic; identifying an optimum print setting from the plurality of print settings that is best suited for the content characteristic; and utilizing the optimum print setting to print the document.

In another embodiment, the method may be broadly summarized by the following steps: determining a stiffness of the media sheet; determining a print job characteristic; using the stiffness and the print job characteristic to identify from a plurality of ejection sequences an optimized ejection sequence; and ejecting the media utilizing the optimized ejection.

In another embodiment, the method may be broadly summarized by the following steps: determining a location of marking material on the media sheet; using the location of marking material to identify from a plurality of ejection sequences an optimized ejection sequence; and ejecting the media utilizing the optimized ejection sequence.

In another embodiment, the method may be broadly summarized by the following steps: determining a mass of marking material on the media sheet; using the mass to identify from a plurality of ejection sequences an optimized ejection sequence; and ejecting the media utilizing the optimized ejection sequence.

Other features and advantages of the present invention will become apparent to one with skill in the art upon examination of the following drawings and detailed description. It is intended that all such additional features and advantages be included herein within the scope of the present invention.

BRIEF DESCRIPTION OF THE SEVERAL VIEWS OF THE DRAWINGS

The invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE INVENTION

Figure 1:
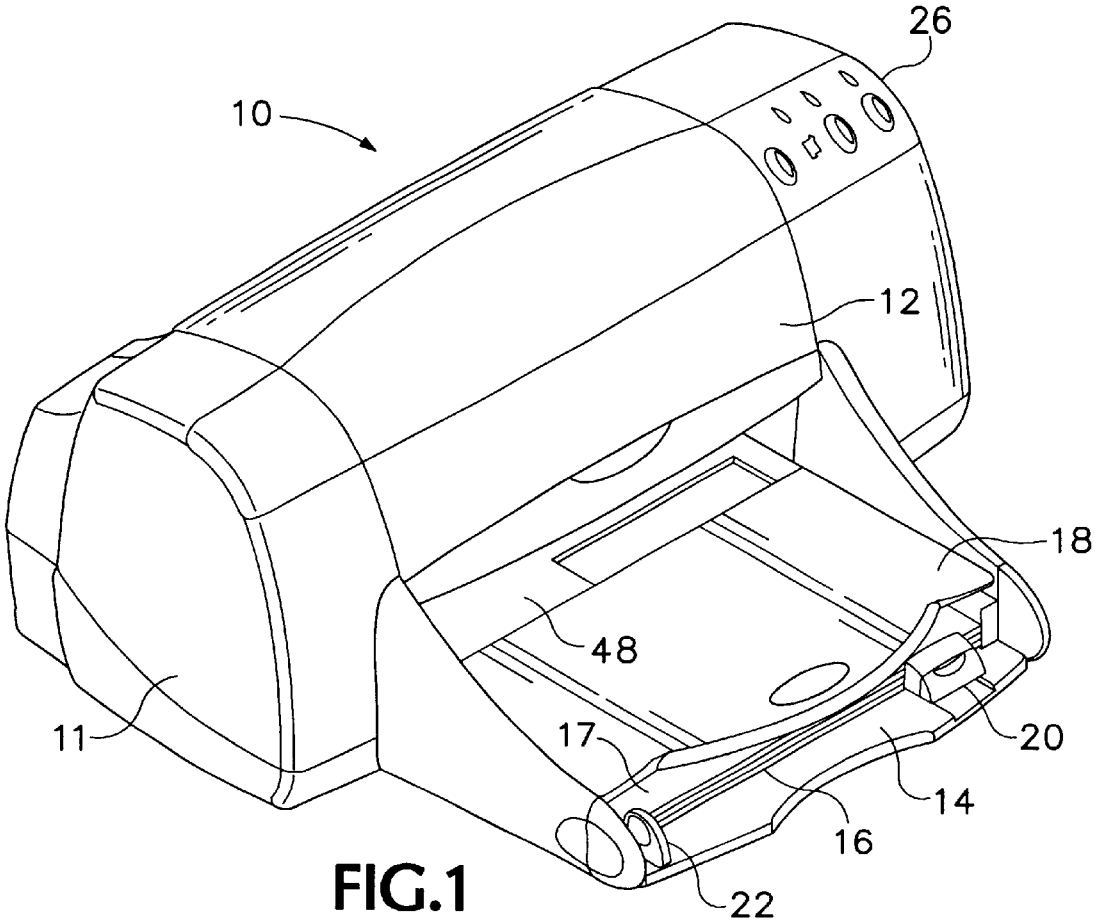
FIG. 1 is a perspective view of an inkjet printer that utilizes the methods of the present invention.

FIG. 1 illustrates an embodiment of an inkjet printing apparatus 10 that utilizes the methods of the present invention. It will be appreciated that the present invention may be practiced with various other imaging devices that include a media ejection sequence in their media handling process. Such imaging devices may include printers using other marking technologies, such as electrophotographic, thermal transfer, and dye sublimation printers, plotters, portable printing units, copiers, scanners, facsimile machines, as well as various combinations of these and other devices. To facilitate description, the concepts of the present invention are described in the environment of an inkjet printing apparatus 10.

The inkjet printing apparatus 10 includes a housing 11 and a lid 12 shown in a closed position. A media tray 14 holds sheets of print media 16 that are fed into the printer 10 by a media transport system (not shown), as known to one of skill in the art. A more detailed description of an exemplary media transport system is provided in U.S. Pat. No. 5,730,537 (hereinafter "the '537 patent"). U.S. Pat. No. 5,730,537 is specifically incorporated by reference in its entirety. The printer 10 includes a controller (not shown) that receives instructions from a host device such as a personal computer or the printer control panel 26. The controller includes logic that distributes control signals and generally controls the operation of the printer 10 and its various components and subsystems, as known to one of skill in the art.

The print media may be any type of suitable sheet material, such as various sizes of plain paper, coated paper, card-stock, envelopes, transparencies and the like. The media tray 14 may include one or more adjustment mechanisms for accommodating different sizes of print media, such as a sliding length adjustment lever 20 and a sliding width adjustment lever 22. An output tray 18 receives sheets of printed media produced by the printer 10.

Figure 2:
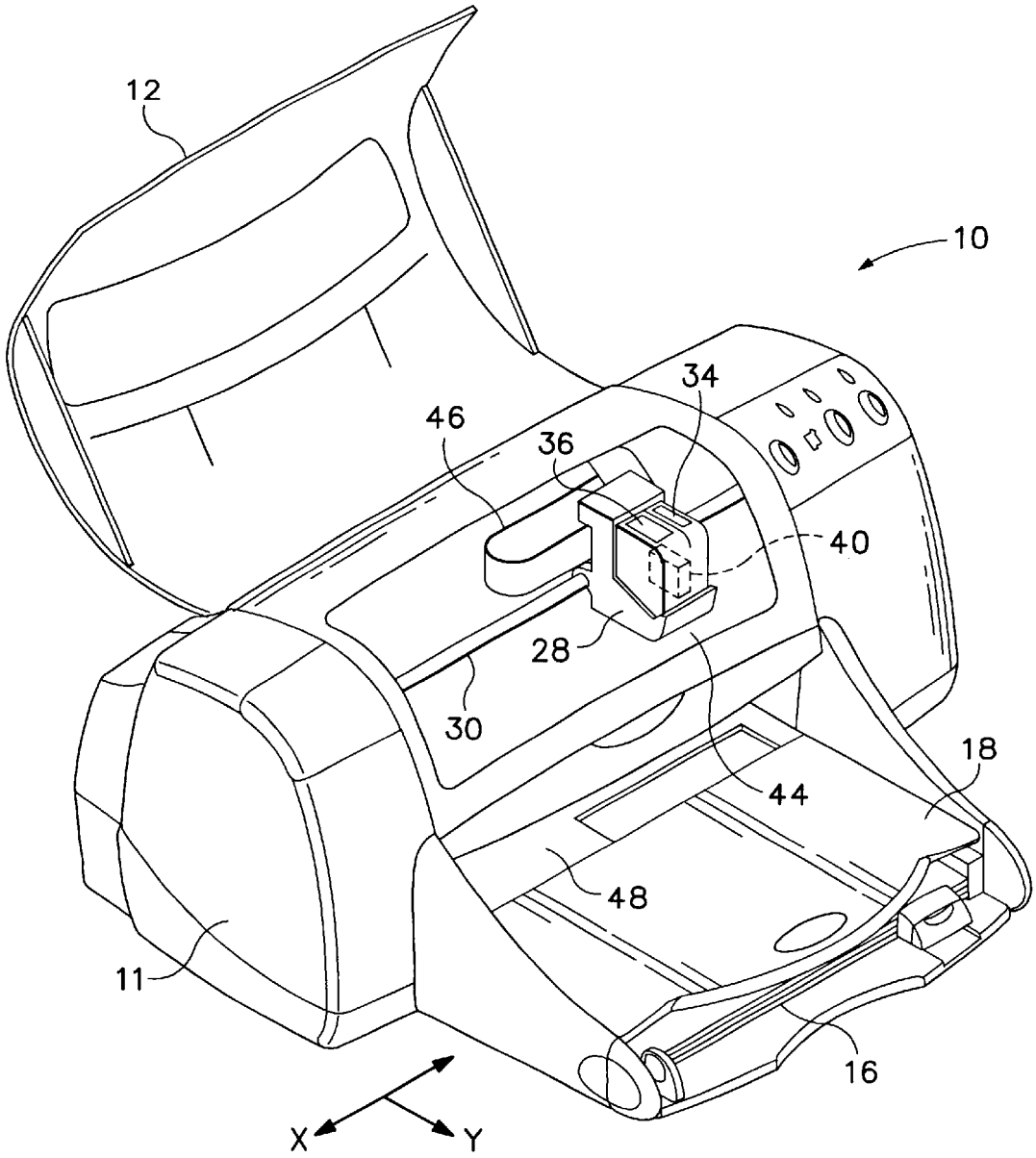
FIG. 2 is a perspective view of the inkjet printer of FIG. 1 with the top cover of the printer opened to reveal the printhead carriage.

FIG. 2 shows the printer 10 with the lid 12 in an open position to reveal a carriage 28. The carriage 28 is slidably mounted on a guide rod 30 for reciprocating motion over the print media. The carriage 28 holds a black inkjet pen 34 and a color inkjet pen 36. The color pen 36 may include three colors of ink, such as cyan, yellow and magenta. Both inkjet pens 34, 36 include a printhead having an array of orifices through which droplets of ink are expelled onto the surface of the media to generate an image. More specifically, the ink is expelled from one or both pens 34, 36 as the carriage 28 moves laterally over a print zone 44 in an x-axis direction. Between carriage scans the media is advanced by the media transport system in a y-axis direction that is perpendicular to the carriage scan x-axis direction. In this manner, an image may be generated in a raster fashion by building up the image line by line. When printing on the media is completed, the media is ejected by the media transport system into the output tray 18.

With continued reference to FIG. 2, an optical emitter/sensor module 40 may also be mounted to the carriage 28. The sensor module 40, pens 34, 36 and carriage 28 are electrically connected to the printer 10 and controller by a flexible ribbon cable 46.

As is known in the art, the optical emitter/sensor module 40 may be utilized to perform various printer calibration operations, such as image registration and linefeed adjustments, and to determine media size and/or type. A typical emitter/sensor module includes one or more light sources, such as Light Emitting Diode (LED) lamps, a photodetector and a lens element. Typically, the emitter/sensor module is propelled back and forth across a media sheet as an LED illuminates a selected region of the sheet. The lens element focuses light from the illuminated region onto the photodetector. As the module scans across the sheet and over a printed pattern or edge of the sheet, the photodetector records variations in collected light flux. Printer electronics calculate the location of the printed pattern or sheet edge by coordinating with an electronic signal from a motion encoder that records the position of the module relative to the printer. A more detailed description of an optical emitter/sensor and its operation in an inkjet printer is provided in U.S. Pat. No. 5,856,833. A more detailed description of the operation of an optical emitter/sensor to determine media type and other media characteristics is provided in pending U.S. application Ser. No. 09/676,100, filed on Sep. 29, 2000. U.S. Pat. No. 5,856,833 and U.S. application Ser. No. 09/676,100 are both specifically incorporated by reference in their entirety.

Turning to the present invention and the selection of an optimized ejection speed, factors other than sheet-to-sheet friction may affect the selection of an optimal ejection speed for a given printed media. For example, a stiffer sheet of media is ejected more reliably with a slower ejection speed than a more flexible sheet. Additionally, print job characteristics, such as the amount and/or location of the marking material on the media, can influence the optimal ejection speed.

In one embodiment of the method of the present invention, the stiffness of a media sheet is utilized to select an optimized ejection sequence for the media sheet. It has been discovered that, in general, less-stiff or relatively flimsy media requires a faster ejection speed than stiffer media. A faster ejection speed helps ensure that less-stiff media completely exits the printing area to avoid under-ejection. By contrast, stiffer media can tend to "sail" over the output tray if ejected with excessive speed. Thus, for stiffer media a relatively slower ejection speed as compared to less-stiff media is preferred.

Accordingly, in this embodiment of the invention, the stiffness of a media sheet is used to identify an optimized ejection sequence from a plurality of ejection sequences having different ejection speeds. A sheet of media having a first stiffness may be ejected at a first ejection speed. A different sheet of media having a second stiffness less than the first stiffness may be ejected at a second ejection speed that is faster than the first ejection speed.

Figure 3:
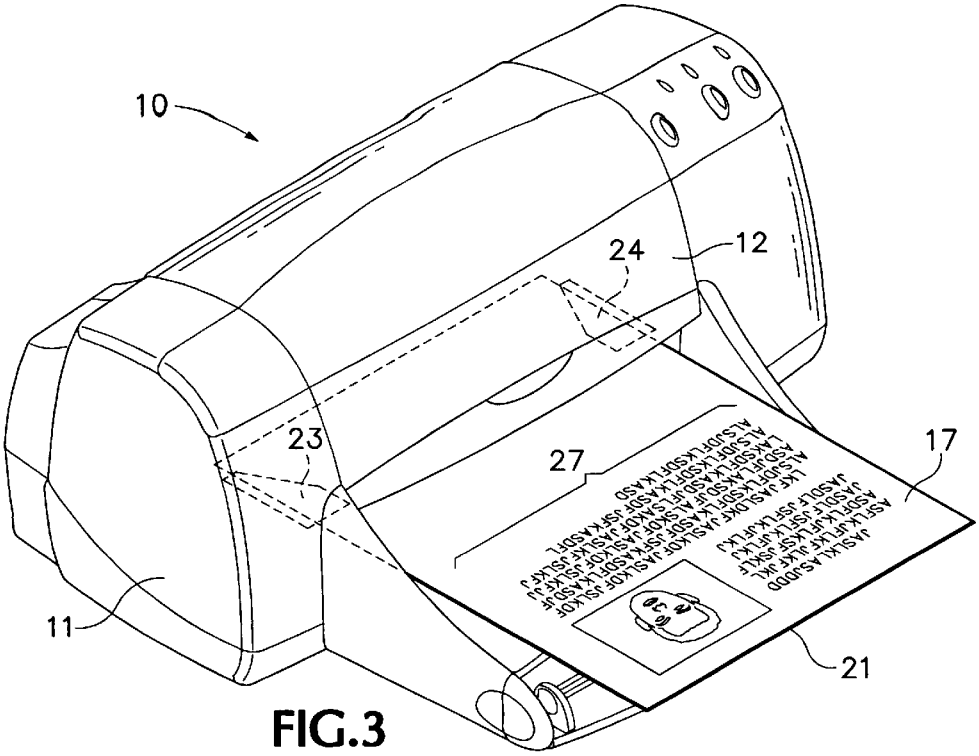
FIG. 3 is a perspective view of the inkjet printer of FIG. 1 showing a media sheet being printed with a majority of marking material adjacent to a leading edge of the sheet.

With reference now to FIG. 3, the printer 10 may also include support rails 23, 24 that selectively support the currently printing media sheet 17 above the output tray 18 as the sheet advances out from the printer. The support rails 23, 24 may be extended to support the media sheet 17 and retracted to allow the sheet to drop into the output tray 18 in different manners for different ejection sequences depending upon the stiffness of the sheet. For example, in a first support sequence the rails 23, 24 may support the media sheet 17 for a first duration, and in a second support sequence the rails 23, 24 may support the media sheet 17 for a second duration longer than the first duration. A more detailed description of the construction and operation of the support rails 23, 24 is provided in the '537 patent that is incorporated by reference.

The stiffness of a media sheet may be determined from media type information entered by a user of the printer through, for example, the printer driver. Alternatively, the media stiffness may be automatically determined by the printer by using, for example, an optical emitter/sensor as described above.

In another embodiment of the method of the present invention, a print job characteristic may be utilized to select an optimized ejection sequence for the media sheet. Any of a variety of print job characteristics may be utilized to select the ejection sequence. As an example and with reference to FIG. 3, it has been discovered that, in general, a media sheet 17 that has a majority of marking material 27 near a leading edge 21 requires a faster ejection speed than a media sheet 19 that has a majority of marking material 29 at a location other than near the leading edge 31 (see FIG. 4).

Figure 4:
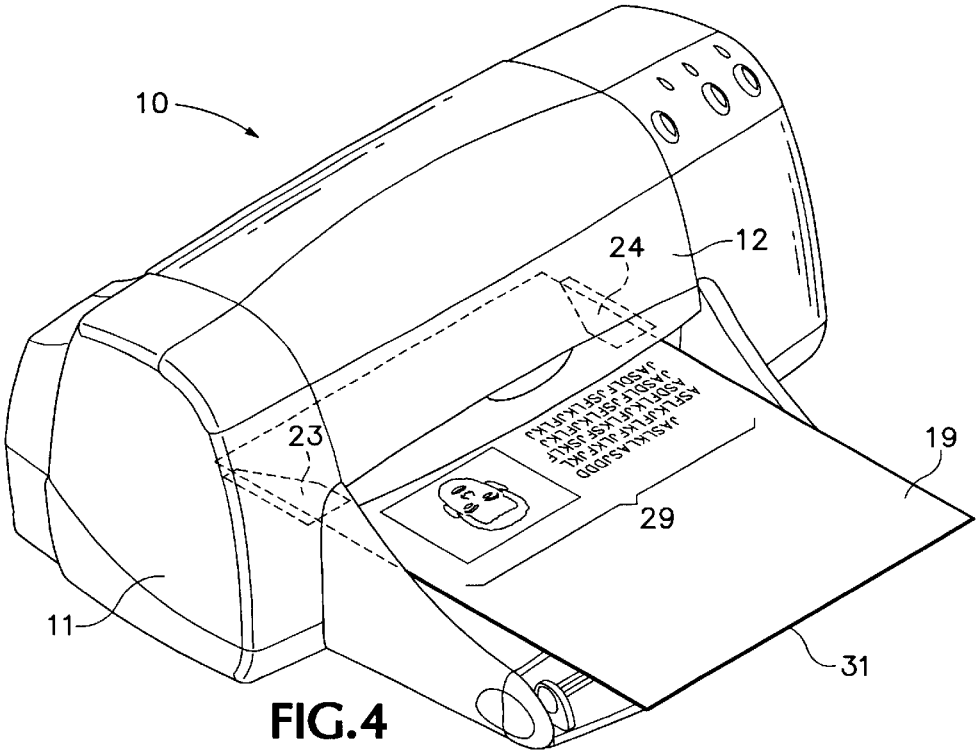
FIG. 4 is a perspective view of the inkjet printer of FIG. 1 showing a media sheet being printed with a majority of marking material in a location other than adjacent to the leading edge of the sheet.

Thus, in this embodiment of the invention, the location of marking material on the media sheet is used to identify an optimized ejection sequence from a plurality of ejection sequences having different ejection speeds. With reference to FIG. 3, a sheet of media having a majority of the marking material adjacent to a leading edge 21 of the media sheet 17 that first emerges from the printer 10 may be ejected at a first ejection speed. With reference to FIG. 4, a different sheet of media 19 having a majority of marking material 29 at a location other than adjacent to the leading edge 31 may be ejected at a second ejection speed that is slower than the first ejection speed. The location of the marking material on the media may be determined by the controller of the printer analyzing the print file prior to printing to map the location of the marking material on the media.

With reference to FIG. 3, the support rails 23, 24 may be extended to support the media sheet 17 and retracted to allow the sheet to drop into the output tray 18 in different manners for different ejection sequences depending upon the location of the marking material on the media. For example, in a first support sequence the rails 23, 24 may support the media sheet 17 for a first duration, and in a second support sequence the rails 23, 24 may support the media sheet 17 for a second duration longer than the first duration.

In another embodiment of the method of the present invention, another print job characteristic that may be analyzed is the mass of marking material on the media. It has been discovered that, in general, the mass of marking material on a media sheet may influence the selection of an optimized ejection sequence. For example, a media sheet that has a mass of marking material that exceeds a threshold amount requires a faster ejection speed than a media sheet that has a mass of marking material below the threshold. This threshold amount may vary depending upon media type, printing conditions and other environmental factors.

Thus, in this embodiment of the invention, the mass of marking material on the media sheet is used to identify an optimized ejection sequence from a plurality of ejection sequences having different ejection speeds. A sheet of media having a mass of marking material greater than or equal to a threshold amount may be ejected at a first ejection speed. A different sheet of media having a mass of marking material less than the threshold amount may be ejected at a second ejection speed that is slower than the first ejection speed. The mass of the marking material on the media may be determined by methods known to one of ordinary skill in the art. For example, the controller of the printer may analyze the print file prior to printing to estimate the amount and mass of the marking material on the media. In an ink jet printer, the controller may also count the number, size, type and/or color of ink drops ejected from the print heads to estimate the amount and mass of the marking material on the media.

As in previous embodiments, the support rails 23, 24 may be extended to support the media sheet and retracted to allow the sheet to drop into the output tray 18 in different manners for different ejection sequences depending upon the mass of the marking material on the media. For example, in a first support sequence the rails 23, 24 may support the media sheet for a first duration, and in a second support sequence the rails 23, 24 may support the media sheet for a second duration longer than the first duration.

In another embodiment of the method of the present invention, both the stiffness of the media sheet and a print job characteristic may be analyzed to determine an optimized ejection sequence. Various combinations of media stiffness and print job characteristics will require different ejection sequences at different speeds. As in previous embodiments, the support rails 23, 24 may be extended to support the media sheet and retracted to allow the sheet to drop into the output tray 18 in different manners for different ejection sequences. For example, in a first support sequence the rails 23, 24 may support the media sheet for a first duration, and in a second support sequence the rails 23, 24 may support the media sheet for a second duration longer than the first duration.

Many variations and modifications may be made to the above-described embodiment(s) of the invention without departing substantially from the spirit and principles of the invention. All such modifications and variations are intended to be included herein within the scope of the present invention.

What is claimed is:

1. A method of controlling ejection of a media sheet from an imaging apparatus comprising:

determining a stiffness of the media sheet;

determining a mass of marking material on the media sheet;

using the stiffness and the mass of marking material to identify from a plurality of ejection sequences an optimized ejection sequence; and ejecting the media utilizing the optimized ejection sequence.

2. The method of claim 1, wherein the plurality of ejection sequences comprises a first support sequence having a first duration and a second support sequence having a second duration longer than the first duration.

3. A method of controlling ejection of a media sheet from an imaging apparatus comprising:

determining a stiffness of the media sheet;

determining a location of marking material on the media sheet;

using the stiffness and the location of marking material to identify from a plurality of ejection sequences an optimized ejection sequence; and ejecting the media utilizing the optimized ejection sequence.

4. The method of claim 3, wherein the plurality of ejection sequences comprises a first sequence having a first ejection speed and a second sequence having a second ejection speed faster than the first ejection speed.

5. The method of claim 4, further including the steps of:

ejecting at the first ejection speed media having a majority of the marking material adjacent to a leading edge of the media sheet that first emerges from the imaging apparatus.

6. A method of controlling ejection of a media sheet from an imaging apparatus comprising:

determining a location of marking material on the media sheet;

using the location of marking material to identify from a plurality of ejection sequences an optimized ejection sequence; and ejecting the media utilizing the optimized ejection sequence.

7. The method of claim 6, wherein the step of determining a location of marking material comprises analyzing a print file to map the location of marking material on the media.

8. The method of claim 6, wherein the plurality of ejection sequences comprise a first sequence having a first ejection speed and a second sequence having a second ejection speed faster than the first ejection speed.

9. The method of claim 8, further including the steps of:

ejecting at the second ejection speed media having a majority of the marking material adjacent to a leading edge of the media sheet that first emerges from the imaging apparatus.

10. The method of claim 6, wherein the plurality of ejection sequences include a first support sequence having a first duration and a second support sequence having a second duration longer than the first duration.

11. A method of controlling ejection of a media sheet from an imaging apparatus comprising:

determining a mass of marking material on the media sheet;

using the mass to identify from a plurality of ejection sequences an optimized ejection sequence; and ejecting the media utilizing the optimized ejection sequence.

12. The method of claim 11, wherein the plurality of ejection sequences comprise a first sequence having a first ejection speed and a second sequence having a second ejection speed faster than the first ejection speed.

13. The method of claim 12, further including the steps of:

ejecting at the first ejection speed media having a mass of marking material greater than a predetermined threshold mass.

14. The method of claim 11, wherein the plurality of ejection sequences include a first support sequence having a first duration and a second support sequence having a second duration longer than the first duration.

* * * * *